US005588035A

United States Patent [19]

Christean et al.

[11] Patent Number: 5,588,035

[45] Date of Patent: Dec. 24, 1996

[54] X-RAY TUBE NOISE AND VIBRATION REDUCTION

[75] Inventors: Paul G. Christean; Dennis H. Runnoe, both of Salt Lake City, Utah

[73] Assignee: Varian Associates, Inc., Palo Alto, Calif.

[21] Appl. No.: 503,114

[22] Filed: Jul. 17, 1995

[51] Int. Cl.[6] ..... H01J 35/20

[52] U.S. Cl. ..... 378/132; 378/125

[58] Field of Search ..... 378/119, 121, 378/125, 131, 132, 139, 144

[56] References Cited

U.S. PATENT DOCUMENTS 5,253,284 10/1993 Kim ..... 378/121

5,265,147 11/1993 Kim et al. ..... 378/131

*Primary Examiner*—Don Wong

*Attorney, Agent, or Firm*—Bella Fishman

[57] ABSTRACT

An X-ray tube of a rotating anode type for reducing acoustic noise and vibration by using an isolating structure which suppresses and prevents transmission of the vibrational energy from the rotating anode assembly to a vacuum envelope and a housing of the X-ray tube. The isolating structure comprises at least one flexible member which is connected between a support structure of the the anode assembly and a neck portion of the vacuum envelope forming a hermetical sealing therewith, and symmetrically disposed isolating members placed between the neck and head portions of the vacuum envelope and the housing, respectively. The flexible members of the isolating structure can be incorporated into the walls of the vacuum envelope.

16 Claims, 5 Drawing Sheets

X-RAY TUBE NOISE AND VIBRATION REDUCTION

FIELD OF THE INVENTION

The present invention relates to X-ray tube art and more particular, to a noise and vibration reduction system for X-ray tubes of the rotating anode type.

BACKGROUND OF THE INVENTION

A conventional X-ray tube of the rotating anode type for medical applications, comprises a housing with a vacuum envelope disposed therein. An anode target is mounted on a shaft assembly for rotation within the vacuum envelope. A cathode assembly is disposed within the vacuum envelope in the vicinity of the anode target. High voltage source is connected to the anode target and the cathode assembly. A cloud of electrons emitted from the cathode are accelerated to high energy and hit the anode target at a focal spot. The anode target emits X-rays in response to the incident electrons. When electrons strike the anode target only a small fraction of their energy is converted to X-rays, while the major portion of the energy is released as heat, thereby elevating the anode target temperature in operation. In order to distribute the thermal load the shaft assembly with the anode target is rotated at approximately 3,000 to 10,000 rpm. The shaft is coupled to the vacuum envelope via bearings. High rotation speeds and accelerations of the anode structure generate vibration of this structure which is transmitted to the vacuum envelope. Since the envelope has a relatively large size it is the primary source of further vibration transmission to the housing surrounding the envelope. The oil which is filled between the envelope and housing for heat dissipation and dielectric purposes transmits a significant portion of the vibration to the housing and it is radiated as acoustic noise. These factors limit the service life of the X-ray tube and cause disturbances to the personnel in the vicinity.

A number of technical decisions have been proposed in the past to achieve X-ray noise reduction. These include lowering the rotation speed of the target, adding a mass on an anode shank mounting area, as well as other techniques.

A prior art design for reducing X-ray tube noise without shortening target life expectancy by lowering the target speed rotation area described, for example, in the U.S. Pat. No. 4,935,948 "X-ray Tube Noise Reduction by Mounting a Ring Mass", and the U.S. Pat. No. 5,265,147. In the U.S. Pat. No. '948, a ring mass is attached on or near the bearing shroud which physically connects the rotor bearing to the vacuum tube Such a ring mass significantly increases the overall weight of the X-ray tube, and, being located near a high voltage region within the tube, creates electrical instability. In the U.S. Pat. No. '147 X-ray tube noise is reduced by sealing the stator mass to the neck portion of the glass vacuum envelope or clamping it with a mechanical clamping device.

An alternative approach to noise reduction in X-ray tubes is described in U.S. Pat. No. 5,253,284, "X-ray Tube Noise Reduction Using Non-Glass Inserts". Although satisfactory in certain respects, such X-ray tubes shall suffer from disadvantages. Thus, the rigid ring, which is used as an insert, requires extensive redesign of an X-ray tube, and does not isolate the vacuum envelope from the source of vibration.

Yet another conventional approach to noise reduction relies on disposing vibration damping means outside X-ray tube. An application of this approach is disclosed in the U.S. Pat. No. 4,433,432 "X-ray Tube Apparatus", where the end portion of the rotary anode X-ray tube is resiliently supported and is equipped with vibration damping means. This vibration damping means is engaged with the bearings of an anode target. Such a design does not disconnect the glass vacuum envelope from the rotating anode vibration source.

SUMMARY OF THE INVENTION

Accordingly, it is an object of the present invention to eliminate the abovedescribed disadvantages associated with conventional X-tube noise reduction techniques. Thus, it is therefore an object of the present invention to provide a quiet, vibration-free X-ray tube.

It is an advantage of the present invention that the incorporation of the isolating structure in the X-ray tube design introduces no changes to the electrical characteristics, and results in minimal additional weight to the tube.

It is a further advantage of the present invention that a wide variety of X-ray tubes for medical applications may be easily adapted to the claimed technology, with no major design modifications required.

In accordance with a preferred embodiment of the present invention, there is provided an X-ray tube which comprises a housing with a vacuum envelope disposed therein. The vacuum envelope has a head portion and a neck portion. An anode assembly is disposed within the vacuum envelope and is extended through the head and neck portions. The anode assembly comprises a rotatable target which is mounted to a shaft. The shaft is connected to a rotor for rotating the anode assembly about an axis of the X-ray tube at a predetermined speed. A cathode assembly is disposed within the head portion of the vacuum envelope in proximity to the anode assembly for generating and focusing a beam of electrons onto a surface of the target for producing X-rays. A flexible isolating member is disposed between and hermetically sealed with the neck portion of the vacuum envelope and a base portion of the rotor for preventing transmission of the vibrational energy from the anode assembly to the vacuum envelope. The flexible isolating member being connected to the rotor, a main source of vibration in the tube, allows substantial isolation of the vibrational energy. Symmetrically disposed isolating members, one of which is placed between the anode mount assembly and the housing and the other placed between the head portion of the vacuum envelope and the housing prevent transmission of the remaining vibrational energy from the vacuum envelope to the housing.

In accordance with another embodiment of the present invention, there is provide an X-ray tube which comprises a housing with a vacuum envelope disposed therewith. The vacuum envelope comprises a cathode assembly which is disposed within the head portion and an anode assembly which is disposed in proximity to the anode assembly and is extended through the head and neck portions of the vacuum envelope. The vacuum envelope is defined by head and neck portions, each portion having a respective cylindrical wall. At least one portion of the vacuum envelope comprises a flexible member which is incorporated into its cylindrical wall.

The main advantage of the present invention is that the flexible isolating member allows the anode assembly and the vacuum envelope to move independently relative to each other, while the additional isolating members are fixing the position of the vacuum envelope and suppressing its vibration within the housing. This systematic approach to suppression of the vibrational energy from sources of vibration, such as the rotating anode assembly and the vacuum envelope, practically eliminates the acoustic noise from the X-ray tube.

These and other features and advantages of the present invention will become clear from the detailed description given below in which embodiments are described in relation to the drawings. The detailed description is presented to illustrate the present invention, but is not intended to limit it.

DESCRIPTION OF THE PREFERRED EMBODIMENT

Figure 1:
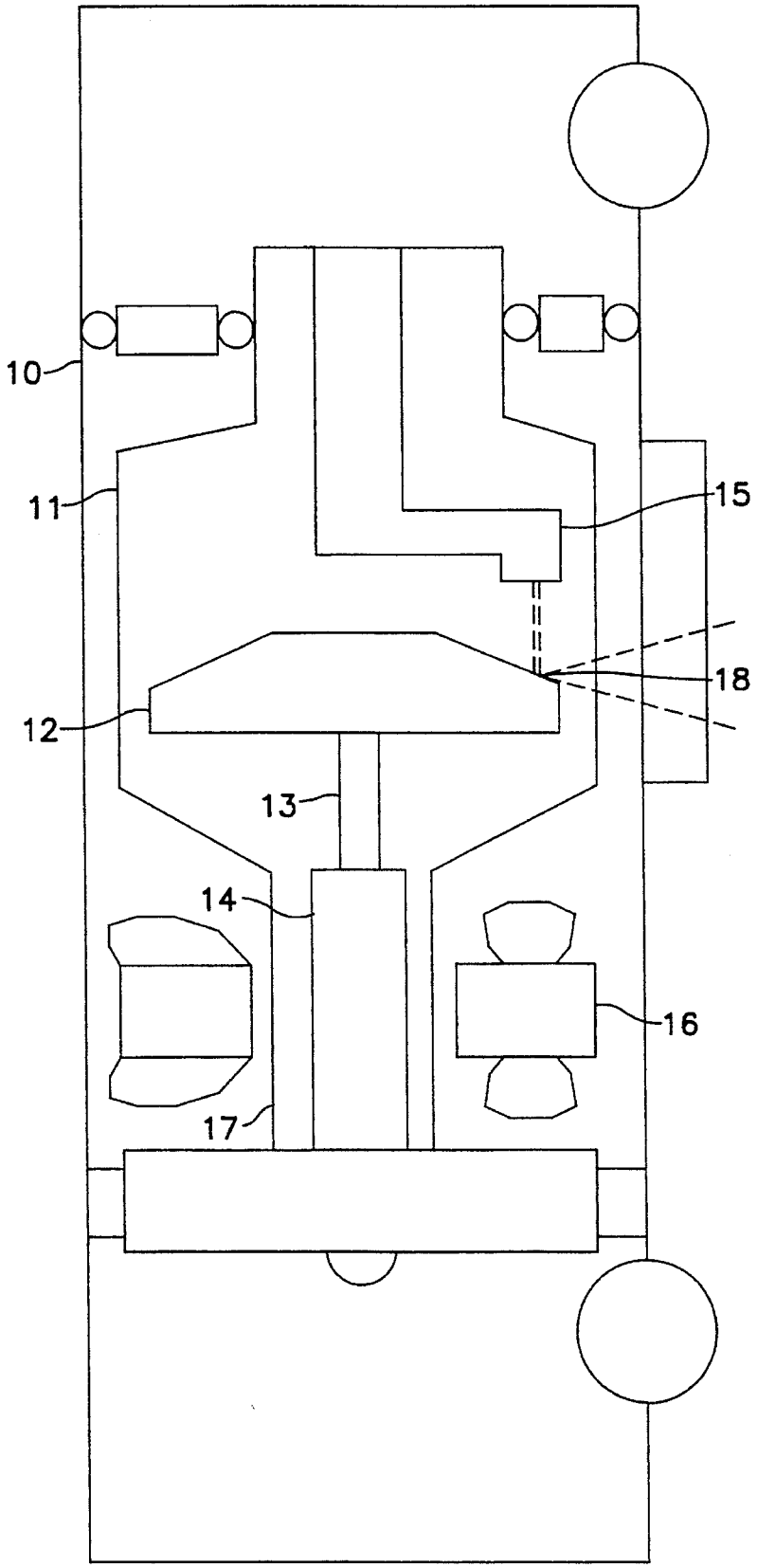
FIG. 1 shows a simplified cross-sectional view of a conventional X-ray tube.

Referring to FIG. 1, there is shown a simplified structure of a rotating anode type X-ray tube having housing 10 and vacuum envelope 11 disposed therewith. An anode assembly is disposed within a large-diameter portion of vacuum envelope 11 and comprises target 12 which is mounted and fixed integral to shaft 13. Bearing assembly 14 serves to facilitate the rotation of target 12. A cathode assembly is positioned opposite to anode target 12 and comprises cathode head 15 and a filament which is connected to an appropriate power source. Stator assembly 16 is fixedly mounted about the exterior of neck portion 17 of vacuum envelope 11. Stator assembly 16 generates a rotating magnetic field which forces a rotor mounted to shaft 13 opposite the stator through the wall of vacuum envelope 11 to rotate anode target 12 at a predetermined speed.

In operation, the cathode and the anode target are maintained at high electrical potentials for obtaining an electron beam from the cathode into focal spot area 18. The electrons bombard the focal spot area with sufficient kinetic energy to generate X-rays which are used to produce medical images.

Figure 2:
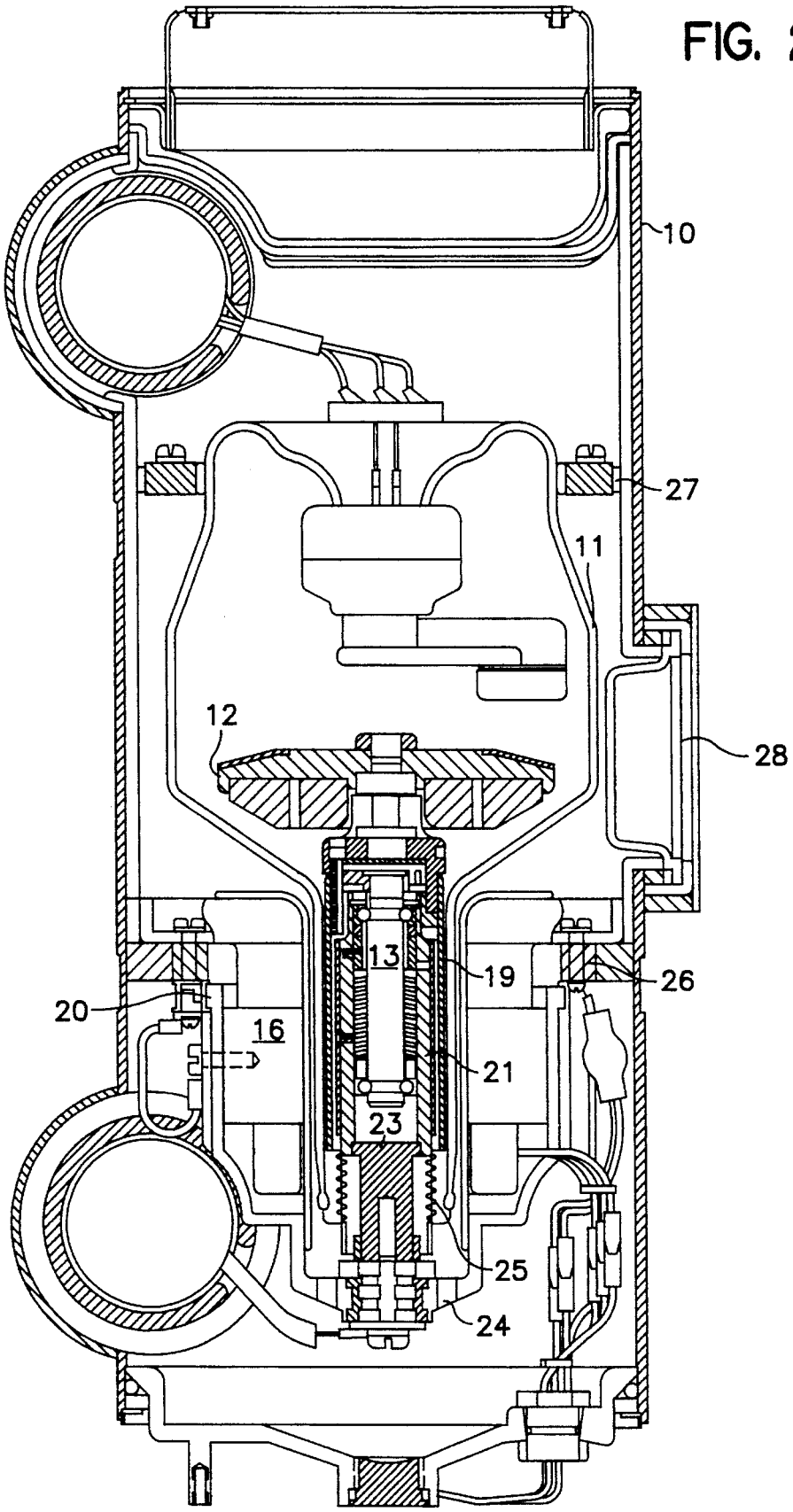
FIG. 2 shows a schematic cross-sectional view of an X-ray tube which incorporates a preferred embodiment of the present invention.

In a preferred embodiment shown in FIG. 2 anode target 12 is connected through shaft 13 to hollow cylindrical rotor 19 having cylindrical sleeve portion. Stator structure 16 is mounted on cylindrical support structure 20 outside vacuum envelope 11. The anode target, the shaft and the rotor are fixed relative to each other. The assembly of these elements is mounted to bearing and support structure 21. Bearing and support structure 21 is mounted to hermetic sealing member 23 which is disposed at the neck portion of vacuum envelope 11 opposite to anode target 12 and is extended inwardly in the axial direction. Hermetic sealing member 23 is supported by housing anode mount assembly 24. Flexible bellows 25 is disposed between bearing and support structure 21 and the neck portion of vacuum envelope 11 for free movement there between. The bellows may be attached to the walls of the vacuum envelope and the elements of the anode assembly by welding, brazing soldering or by any other method used for making hermetic seals in X-ray tubes. These methods for using and attaching the bellows to the glass or metal materials are well known in the art. The bellows material may be any hermetic material with enough elasticity to be flexible under vibrational stress. Typical materials which may be used are any of the types of steel, kovar, nickel, molybdenum or any alloys of such materials.

First isolating member 26 is mounted between housing 10 and cylindrical support structure 20. Second isolating member 27 is mounted between a head portion of vacuum envelope 11 and housing 10. The first and second isolating members suppress vibration of the vacuum envelope induced by rotation of the anode assembly and allow aligning of the vacuum envelope relative to the housing of X-ray tube for assuring a passage of X-rays through housing port 28. The first and second isolating members are made of a vibration damping material, for example, neoprene or rubber.

Figure 3A:
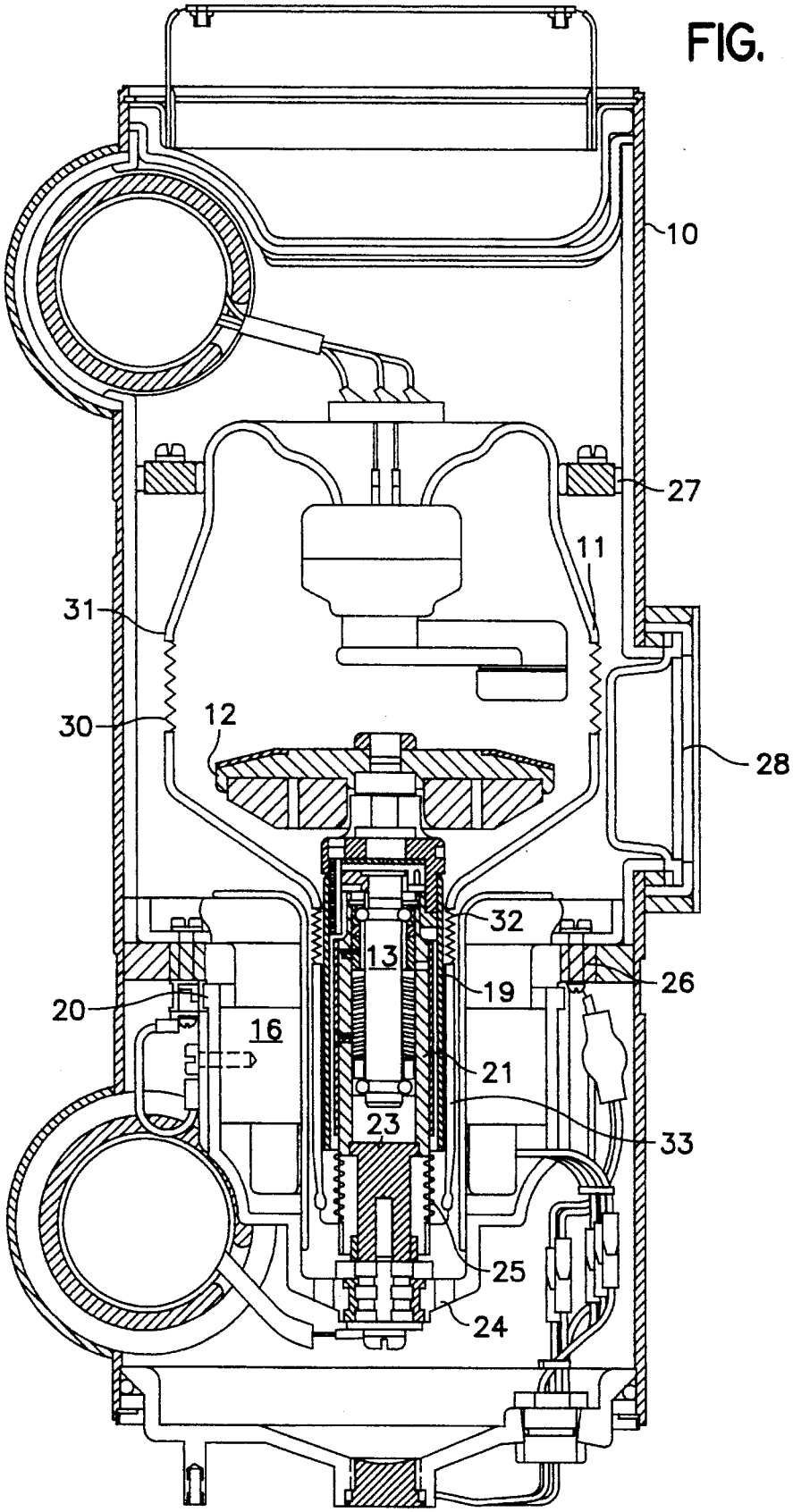
FIG. 3A and 3B show schematic cross-sectional views of an X-ray tube which incorporate other embodiments of the present invention.
Figure 3B:
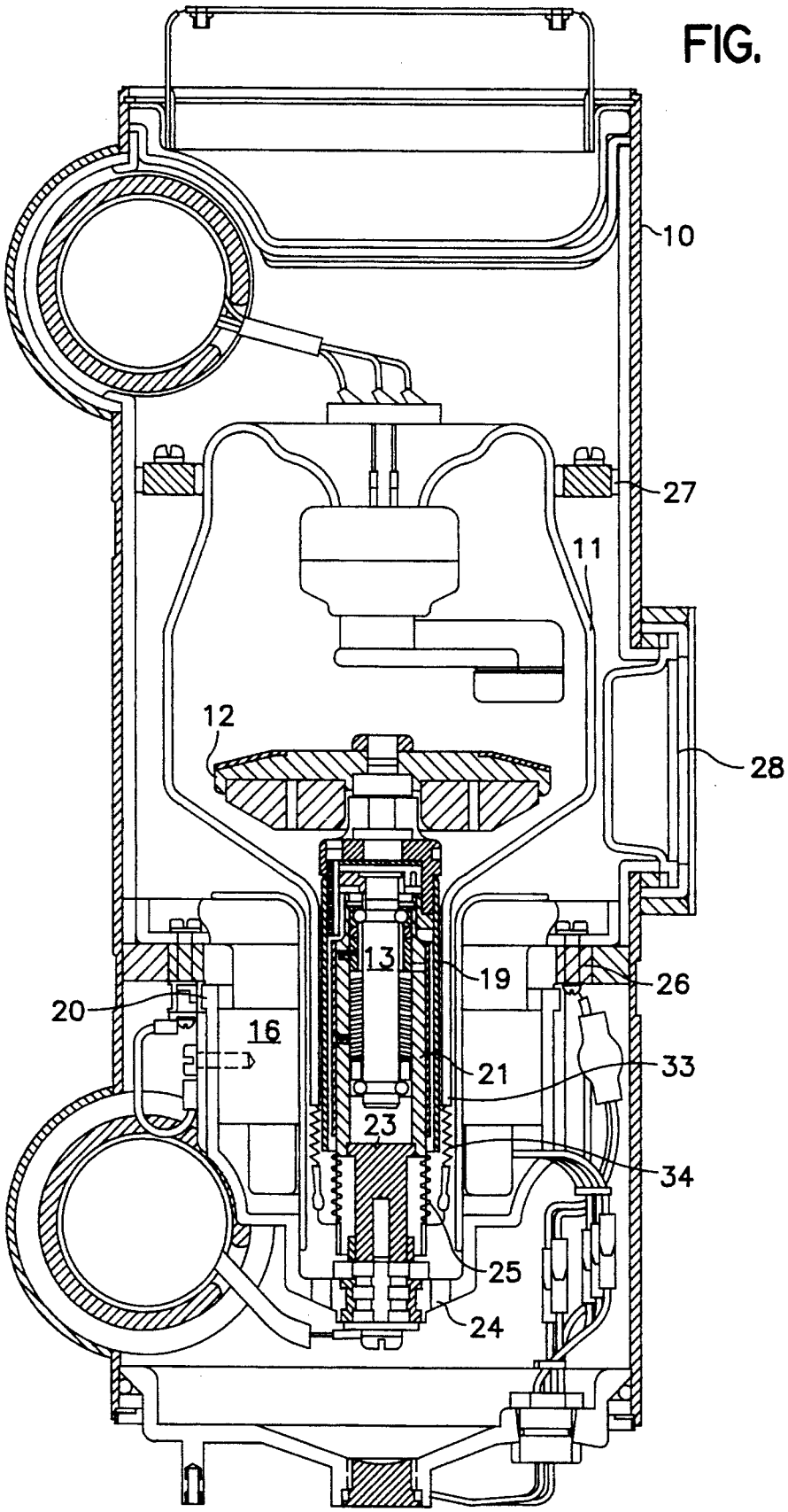

In preventing transmission of the vibrational energy from the anode assembly to the housing, at least one flexible member shall be placed in different parts of the vacuum envelope. As shown in FIG. 3A, bellows 30 is sealed into a cylindrical wall of head portion 31 of the vacuum envelope, and flexible bellows 32 is incorporated into a cylindrical wall of neck portion 33 of the vacuum envelope. Flexible bellows 32 and 33 may be used with or without flexible bellows 25 which is disposed between the base portion of the rotor and neck portion 33 of vacuum envelope 11. In the embodiment shown in FIG. 3B, vacuum envelope 11 comprising flexible bellows 25 which is disposed between the base portion of the rotor and neck portion 33 of vacuum envelope 11 and flexible bellows 34 which is incorporated into a cylindrical wall of neck portion 33.

The use of flexible bellows or any other proper means designed to provide free movement between the anode assembly and vacuum envelope, such as flexible tubes, as a part of X-ray insert structure allows the anode assembly and vacuum envelope structure to move independently of each other. Moreover, an independent movement of the anode assembly and vacuum envelope is suppressed independently by the first and second isolating members respectively.

Figure 4A:
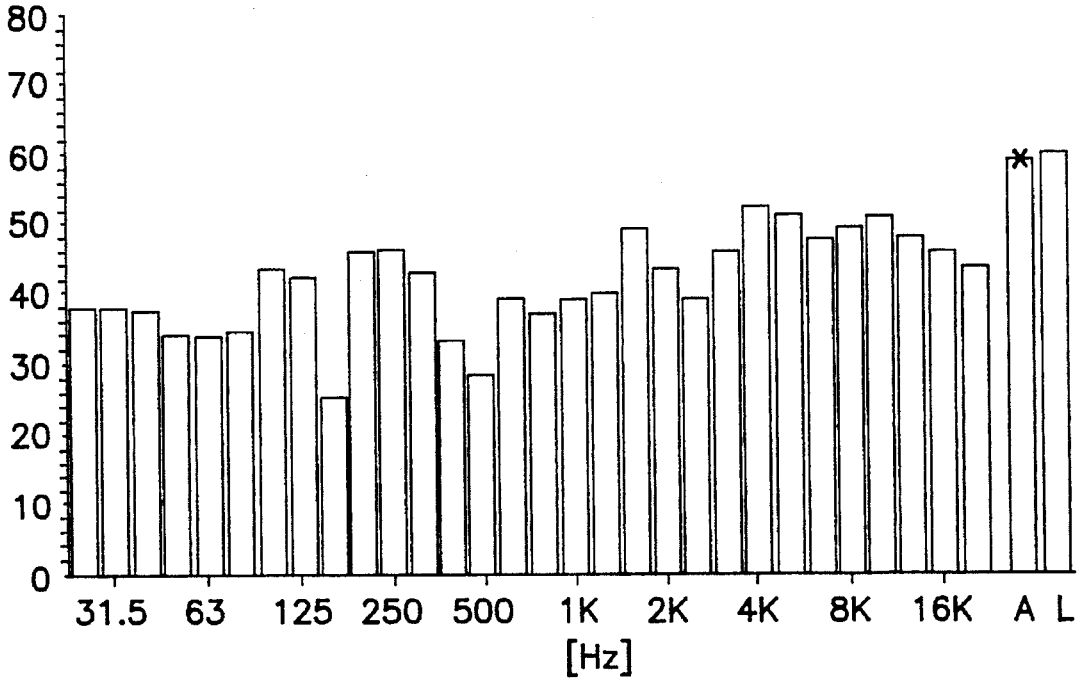
FIGS. 4A and 4B show a respective noise histogram of a conventional X-ray tube and the X-ray tube of present invention for 180 hz speed rotation of an anode assembly.
Figure 4B:
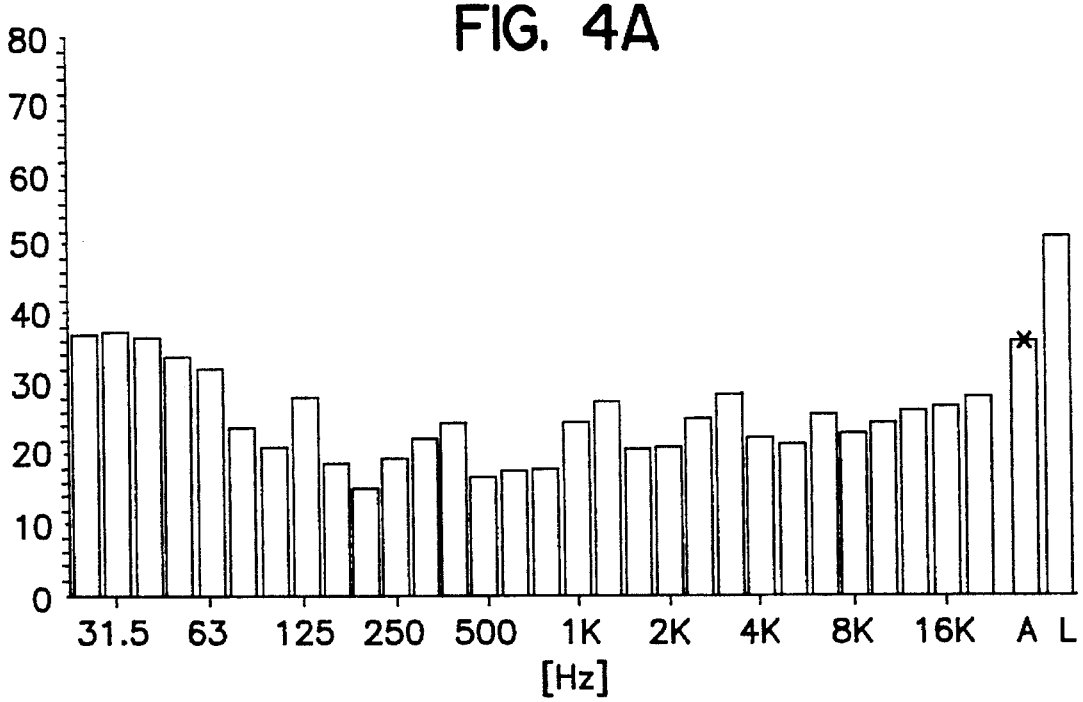

The noise histograms of FIGS. 4A and 4B show the reduction of sound pressure level for a conventional X-ray tube (FIG. 4A) in comparison with the X-ray tube incorporated the present invention (FIG. 4B) for 180 Hz rotation of the anode assembly (10,000 rpm). The preferred series of ⅓ octave bands for these acoustic measurements cover the audible range in ten bands. The center frequencies of these bands are shown on X-axis. Based on the measurements conducted at approximately 61 cm from X-ray tube, the new design of X-ray tube of the present invention allows a 24 dB (A) reduction in noise. This data is calculated with respect to an A-weighted sound pressure level algorithm.

The average noise for the conventional X-ray tube is about 58 dB. The average noise for the X-ray tube of the present invention is about 34 dB. Similar reductions are obtained at other rotational speeds.

The present invention allows significant reduction of transmission of the vibration energy from rotating elements of a vacuum insert of the X-ray tube to a vacuum envelope, while isolating members encompassing the envelope prevent further transmission of vibration to the housing.

The present invention has been disclosed with reference to the preferred and exemplary embodiments. Obviously, modifications and various changes may be made without departing from the spirit and scope of the invention as defined in the appended claims or the equipment thereof.

What is claimed is:

1. An X-ray tube comprising:

a housing;

a vacuum envelope disposed within said housing, said vacuum envelope comprising a head portion and a neck portion;

an anode assembly disposed within said vacuum envelope and extending through said head and neck portion, said anode assembly comprising a rotatable target, a shaft mounted to said target, said shaft extending inwardly along a tube axis, a rotor mounted to said shaft for rotation said anode assembly about said axis at a predetermined speed;

a bearing and support structure, said anode assembly mounted to said bearing and support structure;

a cathode assembly disposed within said head portion in proximity to said anode assembly for generating and focusing a beam of electrons onto said target for producing X-rays;

a high voltage source for maintaining a potential between said rotating anode and said cathode assembly; and a flexible isolating member disposed between said neck portion of said vacuum envelope and said bearing and support structure along said tube axis for providing independent respective movement for said vacuum envelope and said bearing and support structure to prevent transmission of the vibrational energy from said anode assembly to said vacuum envelope, said flexible isolating member being integral with said vacuum envelope.

2. The X-ray tube of claim 1, wherein said flexible isolating member is a bellows.

3. The X-ray tube of claim 2, further comprises a first and second isolating members for preventing transmission of the vibrational energy from said vacuum envelope to said housing, said first isolating member is disposed between housing and neck portion of vacuum envelope and second isolating member is disposed between said housing and head portion of said vacuum envelope.

4. The X-ray tube of claim 3, wherein said first and second isolating members are made of vibration damping material.

5. The X-ray tube of claim 4, wherein said vibration damping material is neoprene.

6. The X-ray tube of claim 4, wherein said vibration damping material is rubber.

7. An X-ray tube comprising:

a housing;

a vacuum envelope placed within said housing;

a first and second electrode structure disposed within said envelope, said first electrode structure forming an anode, said anode comprising a target and a shaft assembly rotatably attached to said target, said second electrode structure forming a cathode spaced apart and oppositely disposed from said anode;

a rotor assembly for rotating said anode about an axis of said tube, said rotor disposed coaxially to said shaft assembly;

at least one flexible member embedded coaxially to said vacuum envelope proximate to said rotor assembly for providing a free movement for a portion of said vacuum envelope proximate to said rotor assembly; and at least a pair of symmetrically disposed isolating members placed between said vacuum envelope and said housing.

8. The X-ray tube of claim 7, wherein said vacuum envelope further comprising a head portion with a cylindrical wall, said flexible member is incorporated in said cylindrical wall of said head portion.

9. The X-ray tube of claim 7, wherein said vacuum envelope further comprising a neck portion with a cylindrical wall, said flexible member is incorporated in said cylindrical wall of said neck portion.

10. The X-ray tube of claim 7, wherein said flexible member is a bellows.

11. An X-ray tube comprising:

a housing;

a vacuum envelope disposed within said housing, said vacuum envelope having a neck portion and a head portion, each said portion having a respective cylindrical wall, and at least one of said portions comprising a bellows being incorporated to said respective cylindrical wall;

an anode assembly, said anode comprising a target and a shaft assembly rotatably attached to said target;

a cathode assembly spaced apart and oppositely disposed from said anode assembly; and a rotor assembly for rotating said target about an axis of said tube, said rotor disposed coaxially to said shaft assembly.

12. An isolating system for reducing the vibrational energy of an X-ray tube, said vibrational energy generated by a rotating anode assembly and transmitted through a bearing and support structure of the anode assembly to a vacuum envelope which is disposed inside an X-ray tube housing, said isolating system comprising:

at least one flexible member disposed between said bearing and support structure of said anode assembly and said vacuum envelope for providing independent respective movement for said bearing and support structure and said vacuum envelope to suppress the vibrational energy from said anode assembly, and a pair of attaching members disposed symmetrically between said housing of X-ray tube and said vacuum envelope for fixing the position of and suppressing the vibration from said vacuum envelope.

13. A method of reducing the vibrational energy of an X-ray tube, said vibrational energy generated by a rotating anode assembly within a vacuum envelope which is disposed inside an X-ray tube housing, said method comprising the steps of:

coaxially placing a bellows between a neck portion of said vacuum envelope and a support structure of said rotating anode assembly;

hermetically attaching said bellows to said vacuum envelope and said support structure; and positioning a pair of isolating members between said vacuum envelope and said tube housing.

14. A method of reducing the vibrational energy of an X-ray tube, said vibrational energy generated by a rotating anode assembly which is disposed within a vacuum envelope having head and neck portions with respective cylindrical walls, said vacuum envelope being disposed within an X-ray tube housing, said method comprising the steps of:

incorporating at least one bellow to the cylindrical wall of at least one portion of said vacuum envelope;

forming a hermetical seal between said cylindrical wall and said flexible member.

15. The method of claim 14, further comprising the step of:

placing a first and second isolating members between said head and neck portions of said vacuum envelope respectively.

16. The method of claim 15, further comprising the step of:

placing additional bellows between said neck portion of said vacuum envelope and a support structure of said rotating anode assembly.

* * * * *